US005344294A

United States Patent [19]

Itoh et al.

[11] Patent Number: 5,344,294

[45] Date of Patent: Sep. 6, 1994

[54] SCROLL TYPE FLUID APPARATUS OF DECREASED SIZE

[75] Inventors: Takahide Itoh; Takahisa Hirano; Tetsuo Shigeoka, all of Nagoya; Ryuhei Tanigaki, Aichi, all of Japan

[73] Assignee: Mitsubishi Jukogyo Kabushiki Kaisha, Tokyo, Japan

[21] Appl. No.: 83,919

[22] Filed: Jun. 28, 1993

[30] Foreign Application Priority Data

Jun. 29, 1992 [JP] Japan ..... 4-170647

[51] Int. Cl.[5] ..... F01C 1/04

[52] U.S. Cl. ..... 418/55.2

[58] Field of Search ..... 418/55.2; 29/888.022

[56] References Cited

U.S. PATENT DOCUMENTS

| | | | |
|---|---|---|---|
| 4,304,535 | 12/1981 | Terauchi | 418/55.2 |
| 4,477,239 | 10/1984 | Yoshii et al. | 418/55.2 |
| 4,494,914 | 1/1985 | Shiibayashi | 418/55.2 |

FOREIGN PATENT DOCUMENTS

| | | | |
|---|---|---|---|
| 0009355 | 7/1979 | European Pat. Off. . | |
| 0010402 | 10/1979 | European Pat. Off. . | |
| 0502513 | 5/1992 | European Pat. Off. . | |
| 55-37537 | 3/1980 | Japan . | |
| 55-51986 | 4/1980 | Japan . | |
| 57-188793 | 11/1982 | Japan | 418/55.2 |
| 63-201381 | 8/1988 | Japan | 418/55.2 |

*Primary Examiner*—John J. Vrablik

*Attorney, Agent, or Firm*—Arnold, White & Durkee

[57] ABSTRACT

An object of the present invention is to decrease the diameter of end plate of a fixed scroll and the diameter of orbiting locus circle of an orbiting scroll, by which the inside diameter of a housing is reduced, thereby the apparatus being made compact. The constitution is such that the center P of the end plate 211 of the fixed scroll 21 lies on the straight line D starting at the wrap end point T of the outermost end of the spiral wrap 212 and passing through the involute unrolled angle position C of the base circle A and at the position shifting one-half the orbiting radius a in the direction reverse to the outermost wrap end of the spiral wrap 212.

3 Claims, 3 Drawing Sheets

SCROLL TYPE FLUID APPARATUS OF DECREASED SIZE

FIELD OF THE INVENTION AND RELATED ART STATEMENT

This invention relates to a scroll type fluid apparatus which is provided with a fixed scroll and an orbiting scroll engaging so that the spiral wraps faces to each other to drive the orbiting scroll with respect to the fixed scroll while checking rotation by means of a rotation check mechanism.

In a scroll type fluid apparatus of prior art, a fixed scroll and a orbiting scroll were housed in a cup-shaped member called a housing. Therefore, the inside diameter of the housing had to be at least larger than the diameter of end plate of the fixed scroll and the diameter of orbiting locus circle of the orbiting scroll. However, smaller inside diameter of housing was needed to make the apparatus compact.

In the conventional apparatus, a spiral wrap 3 disposed on an end plate 2 of a fixed scroll 1 is formed in an involute curve form on the basis of a base circle A as shown in FIG. 4. Therefore, it has been proposed to shift the center P of the end plate 2 of the fixed scroll 1 in the direction reverse the outermost end of the spiral wrap 3 on the straight line B starting at wrap end point T at the outermost end of the spiral wrap 3 and passing through the center O of the base circle A by a distance one-half the orbiting radius a of the orbiting scroll.

By adopting this proposal, the diameter of end plate of the fixed scroll 1 and the diameter of the orbiting locus circle of the orbiting scroll can be decreased by similarly shifting the center of the end plate of the orbiting scroll from the center of the base circle A of the spiral wrap by a distance one-half the orbiting radius a of the orbiting scroll. Thus, the inside diameter of the housing can be reduced, thereby the apparatus being made compact.

If the diameter of end plate of the fixed scroll 1 and the diameter of the orbiting locus circle of the orbiting scroll can be further decreased by an improvement of the aforesaid method, the inside diameter of the housing is expected to be reduced further, thereby the apparatus being made more compact.

OBJECT AND SUMMARY OF THE INVENTION

In view of the foregoing, it is an object of the present invention to provide a scroll type fluid apparatus in which the diameter of end plate of a fixed scroll and the diameter of the orbiting locus circle of an orbiting scroll are decreased, so that the inside diameter of a housing is reduced, thereby the apparatus being made compact.

To achieve the above object, the present invention is constituted as follows:

(1) In a scroll type fluid apparatus comprising a pair of fixed scroll and orbiting scroll being engaged with each other by spiral wraps set up on their respective end plates, the orbiting scroll being revolved with respect to the fixed scroll while its rotation is checked by a rotation check mechanism, the center of the end plate of the fixed scroll lies at a distance one-half the orbiting radius in the direction reverse to the outermost wrap end apart from the involute unrolled angle position on the circumference of the base circle of the spiral wrap and indicating the outermost end direction of the spiral wrap of the fixed scroll.

(2) The wall thickness of a part of the spiral wrap is decreased by cutting the external wall of the spiral wrap at the peripheral portion of the fixed scroll so that the distance from the periphery of the end plate of the fixed scroll to its center is decreased.

(3) The diameter of the end plate of the orbiting scroll is the same as the diameter of the orbiting locus circle of the orbiting scroll or the end plate of the fixed scroll, and the end plate of the orbiting scroll is formed so as to not protrude from the outer periphery of the end plate of the fixed scroll at any orbiting angle.

The operation of the present invention will be described below.

In the invention corresponding to the foregoing (1), when the distance from the wrap end point at the outermost end of the spiral wrap to the center of the base circle is taken as r, the radius of the base circle as b, and the orbiting radius of the orbiting scroll as a, the radius R of end plate of the fixed scroll is calculated by the pythagurean therein by the following expression.

$$R = \sqrt{r^2 - b^2} + (a/2) \quad \text{(i)}$$

On the other hand, when the center of the fixed scroll is placed at the position shifting one-half the orbiting radius in the direction reverse to the outermost wrap end from the center of the spiral wrap, the radius S of end plate of the conventional fixed scroll is calculated by the following expression.

$$S = r + (a/2) \quad \text{(ii)}$$

Therefore, the difference between the radius S of end plate of the conventional fixed scroll and the radius R of that of the present invention is calculated by subtracting Expression (i) from Expression (ii).

$$S - R = r\{1 - \sqrt{1 - (b^2/r^2)}\} \quad \text{(iii)}$$

Since $r > b$, it is obvious that $S - R > 0$. Therefore, $R < S$, so that the diameter of end plate of the fixed scroll can be made smaller.

In the invention corresponding to the foregoing (2), the distance r from the outermost wrap end point of the spiral wrap of the fixed scroll to the center of the base circle can be further decreased, so that the diameter of end plate of the fixed scroll can be made still smaller from the relationship shown in Expression (i).

In the invention corresponding to the foregoing (3), the diameter of the orbiting locus circle of the orbiting scroll is the same as the diameter of the end plate of the fixed scroll, and the end plate of the orbiting scroll is formed so as to not protrude from the outer periphery of the end plate of the fixed scroll at any orbiting angle. Therefore, the inside diameter of the housing can be further reduced in accordance with the diameter of end plate of the fixed scroll.

As described above, the present invention can provide a scroll type fluid apparatus in which the diameter of the end plate of the fixed scroll and the diameter of the orbiting locus circle of the orbiting scroll can be decreased, by which the inside diameter of the housing can be reduced, thereby the apparatus being made compact.

DETAILED DESCRIPTION OF A PREFERRED EMBODIMENT

An embodiment of the present invention will be described below with reference to the drawings.

Figure 1:
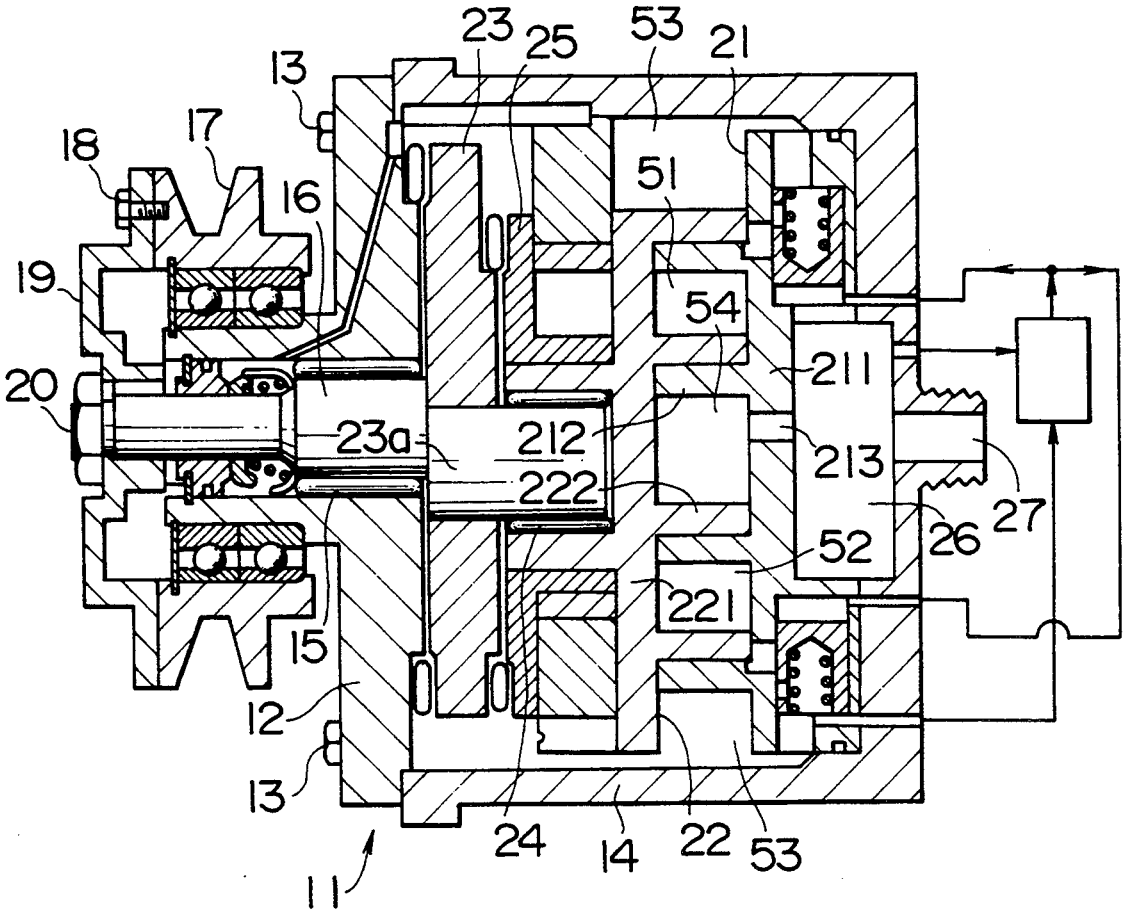
FIG. 1 is a sectional view of a scroll type fluid apparatus in accordance with an embodiment of the present invention.

FIG. 1 is a sectional view of a scroll type fluid apparatus in accordance with the present invention. In this figure, a housing 11 consists of an front end plate 12 and a cup-shaped member 14 fastened to the front end plate 12 with bolts 13. A through hole is formed in the center of the front end plate 12, and a bearing 15 disposed in this through hole rotatably carries a main shaft 16 passing through the through hole. A front cover 19 fastened to a pulley 17 with bolts 18 is connected to on end of the main shaft 16 with a large bolt 20.

In the housing 11, a fixed scroll 21 and an orbiting scroll 22 are disposed in such a manner that they are facing to each other. The fixed scroll 21, comprising an end plate 211 and a spiral wrap 212 set up on the surface facing the orbiting scroll 22, is fixed to the cup-shaped member 14. The orbiting scroll 22, comprising an end plate 221 and a spiral wrap 222 set up on the surface facing the fixed scroll 21, is connected to a crank pin 23a, which is disposed eccentrically to an orbiting drive mechanism 23 connected to the other end of the main shaft 16, via a radial bearing 24, and is provided with a rotation check mechanism 25. The spiral wrap 212 of the fixed scroll 21 and the spiral wrap 222 of the orbiting scroll 22 are formed in substantially the same shape.

The fixed scroll 21 and the orbiting scroll 22 are engaged, as shown in the figure, so that the spiral wraps 212 and 222 are off-centered by the orbiting radius in such a manner the orbiting scroll revolves in solar motion and their angle is shifted 180 degrees. Thus, a plurality of compression chambers 51 and 52 which are substantially symmetric with respect to the center of two spiral wraps 212 and 222 are formed.

A suction chamber 53 into which gas flows through a suction pipe (not shown) is formed at the wrap end portion at the outermost end of the spiral wrap 212 of the fixed scroll 21 and the wrap end portion at the outermost end of spiral wrap 222 of the orbiting scroll 22. Also, a discharge small chamber 54 is formed at the central portion by the spiral wrap 212 of the fixed scroll 21 and the spiral wrap 222 of the orbiting scroll 22. A discharge chamber 26, which communicates with the discharge small chamber 54 through a discharge port 213 formed in the end plate 211 of the fixed scroll 21, is formed at the bottom center of the cup-shaped member 14. The compressed gas discharged into the discharge chamber 26 flows out through a discharge pipe 27.

Figure 2:
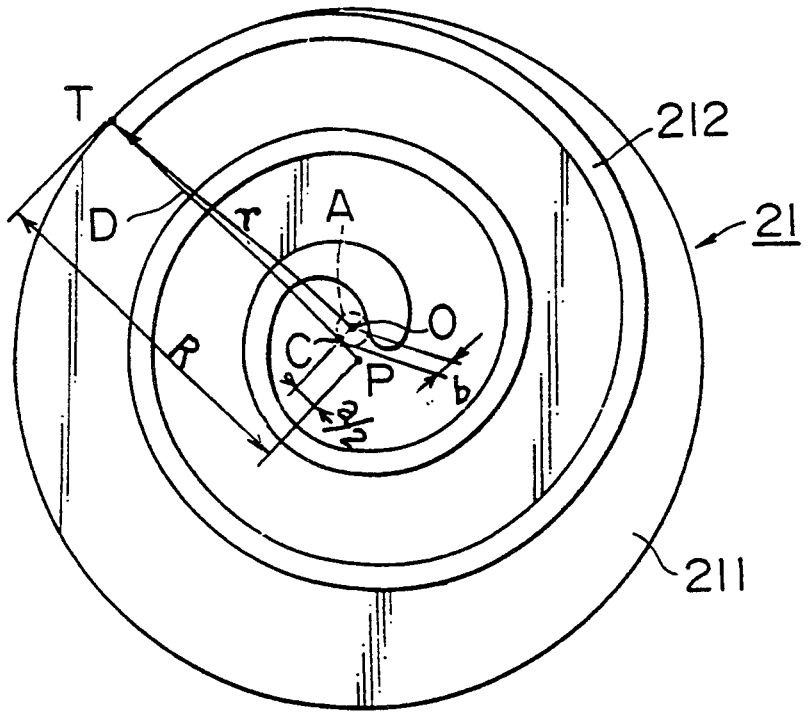
FIG. 2 is a front view of a fixed scroll in accordance with the embodiment shown in FIG. 1.

FIG. 2 is a front view of the fixed scroll 21. The spiral wrap 212 of the fixed scroll 21 is formed by an involute curve defined by a base circle A. The center P of the end plate 211 of the fixed scroll 21 lies on the straight line D starting at the wrap end point T of the outermost end of the spiral wrap 212 and passing through the involute unrolled angle position C of the base circle A and at the position shifting one-half the orbiting radius a in the direction reverse to the outermost wrap end of the spiral wrap 212.

In this embodiment having such a constitution, when the pulley 17 is rotated by a not illustrated drive source, the rotation of the pulley 17 turns the main shaft 16, and in turn the rotation of the main shaft 16 turns the orbiting drive mechanism 23. Then, the crank pin 23a, which is installed eccentrically to the orbiting drive mechanism 23, revolves a circular locus of orbiting radius a. Thus, the orbiting scroll 22 similarly revolves on a circular locus of orbiting radius a while its rotation is checked by the rotation check mechanism.

Then, a linear contact of the spiral wrap 212 of the fixed scroll 21 with the spiral wrap 222 of the orbiting scroll 22 moves from the outermost wrap end of each spiral wrap toward the center, so that the compression chambers 51 and 52 move toward the spiral center while reducing their respective volume. Accordingly, the gas flowing into the suction chamber 53 through the suction pipe is sucked from the opening of the wrap end portion at the outermost end of spiral wraps 212 and 222 into the compression chambers 51 and 52, and supplied the discharge small chamber 54 at the center while being compressed. The compressed gas is discharged from the discharge small chamber 54 to the discharge chamber 26 through the discharge port 213 formed in the end plate 211 of the fixed scroll 21. This discharged compressed gas flows out from the discharge chamber 26 to the outside through the discharge pipe 27.

According to this embodiment, the radius R of the end plate 211 of the fixed scroll 21 is a distance from the wrap end point T at the outermost end of the spiral wrap 212 to point P. When the distance from the wrap end point T at the outermost end of the spiral wrap 212 to the center O of the base circle A is taken as r, the distance of the radius CO the base circle A as b, and the orbiting radius of the orbiting scroll 22 as a, the distance of CP is a/2, and the radius R is calculated by the above-mentioned Expression (i).

Figure 4:
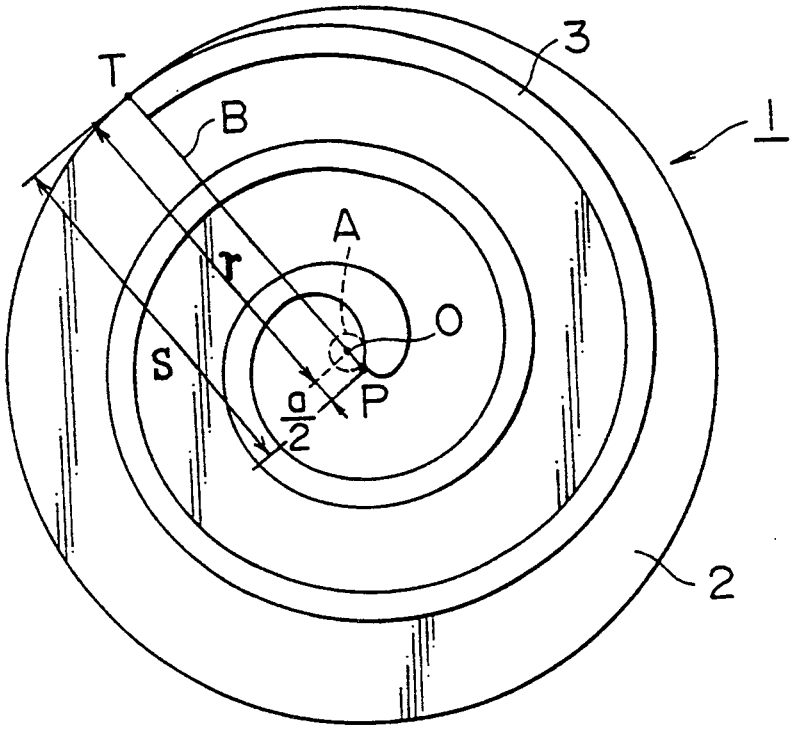
FIG. 4 PRIOR ART
FIG. 4 is a front view of a fixed scroll of prior art.

Therefore, the radius S of the end plate of the conventional fixed scroll (shown in FIG. 4) is calculated by the above-mentioned Expression (ii), and the difference between the radius S of the end plate of the conventional fixed scroll and the radius R of the end plate of fixed scroll of this embodiment is calculated by the above-mentioned Expression (iii).

The result is $R<S$; therefore, the radius R of the end plate 211 of the fixed scroll 21 of this embodiment can be smaller than the radius S of the end plate of the conventional fixed scroll.

As a result, the inside diameter of the housing can be decreased in accordance with the fixed scroll 21, thereby the apparatus being made compact.

Figure 3:
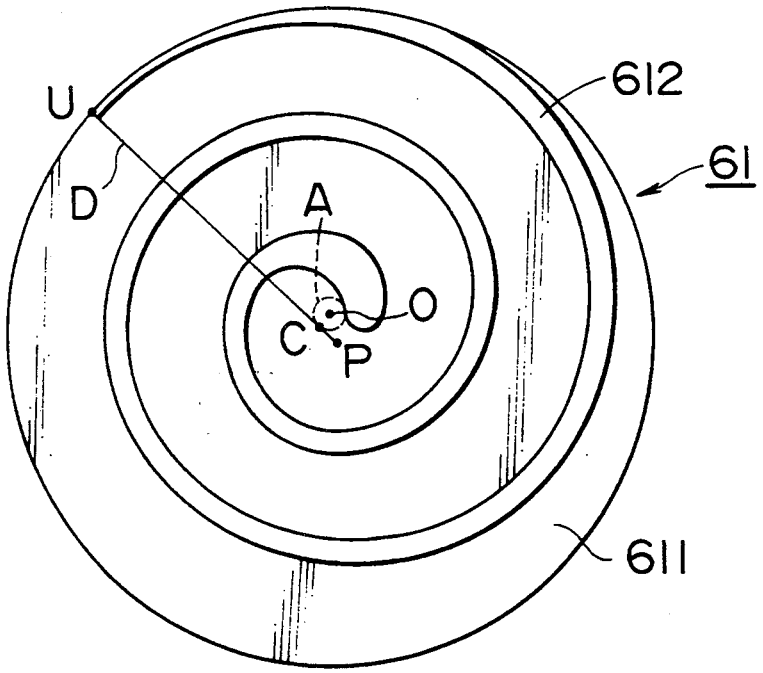
FIG. 3 is a front view of a fixed scroll in accordance with another embodiment of the present invention.

FIG. 3 shows a fixed scroll of another embodiment of the present invention.

For the fixed scroll 61 of this embodiment, the wall thickness at the peripheral portion of the spiral wrap is decreased as compared with the spiral wrap 212 of the fixed scroll 21 in the aforesaid embodiment by cutting or grinding the external wall to the extent that the compression of gas performed by the orbiting scroll is not disturbed. The radius of the end plate 211 of the fixed scroll 21 can be reduced by the amount of decreased wall thickness at the peripheral portion of the spiral wrap 212. The difference between the distance of PT in the aforesaid embodiment and the distance of PU in this embodiment indicates the cut or ground amount of wall thickness at the wrap end portion of the spiral wrap.

An orbiting scroll and housing are formed in accordance with this fixed scroll 61. Other construction is completely the same as that in the aforesaid embodiment; therefore, the explanation is omitted.

According to this embodiment, the wall thickness at the peripheral portion of the spiral wrap of the fixed scroll is decreased to the extent that the compression of gas is not disturbed, by which the radius of the end plate is reduced. Therefore, the radius of the end plate of the fixed scroll can be smaller than that in the aforesaid embodiment while the safety for compression is assured, by which the inside diameter of the housing is further reduced, thereby the apparatus being made more compact.

We claim:

1. A scroll type fluid apparatus comprising a fixed scroll and orbiting scroll being engaged with each other by spiral wraps on their respective end plates, said orbiting scroll being revolved with respect to said fixed scroll while its rotation is checked by a rotation check mechanism, wherein the center of the end plate of said fixed scroll lies along a line extending from the outermost end of said spiral wrap through the involute unrolled angle position on the circumference of the base circle of the spiral wrap at a distance of one-half the orbiting radius from the involute unrolled angle position in a direction from said involute unrolled angle position extending away from said outermost end of said spiral wrap.

2. A scroll type fluid apparatus according to claim 1 wherein the wall thickness of a part of said spiral wrap is decreased by cutting the external wall of said spiral wrap at the peripheral portion of said fixed scroll so that the distance from the periphery of the end plate of said fixed scroll to ills center is decreased.

3. A scroll type fluid apparatus according to claim 1 wherein the end plate of said orbiting scroll is formed so as to not protrude from the outer periphery of the end plate of said fixed scroll at any orbiting angle.

* * * * *